US009771852B2

(12) United States Patent
Steigert et al.

(10) Patent No.: US 9,771,852 B2
(45) Date of Patent: Sep. 26, 2017

(54) EXHAUST PIPE FLANGE

(71) Applicant: TENNECO GMBH, Edenkoben (DE)

(72) Inventors: Andreas Steigert, Lambrecht (DE); Markus Geminn, St. Martin (DE)

(73) Assignee: TENNECO GMBH, Edenkoben (DE)

( * ) Notice: Subject to any disclaimer, the term of this patent is extended or adjusted under 35 U.S.C. 154(b) by 31 days.

(21) Appl. No.: 14/631,981

(22) Filed: Feb. 26, 2015

(65) Prior Publication Data

US 2015/0260077 A1 Sep. 17, 2015

(30) Foreign Application Priority Data

Mar. 12, 2014 (DE) ..... 10 2014 103 314

(51) Int. Cl.
*F01N 13/18* (2010.01)
*F01N 3/02* (2006.01)
*F01N 13/10* (2010.01)

(52) U.S. Cl.
CPC ..... *F01N 13/1827* (2013.01); *F01N 3/02* (2013.01); *F01N 13/10* (2013.01); *F01N 13/1805* (2013.01); *F01N 2450/22* (2013.01)

(58) Field of Classification Search
CPC .. F01N 13/10; F01N 13/1805; F01N 13/1827; F01N 13/1811; F01N 2450/22; F01N 13/1844; F01N 13/1855
USPC ..... 60/322, 323, 324
See application file for complete search history.

(56) References Cited

U.S. PATENT DOCUMENTS 4,060,982 A * 12/1977 Konishi ..... F01N 3/26 228/165
4,170,260 A * 10/1979 Rudd ..... F01N 13/1805 123/41.69
5,087,058 A * 2/1992 Miura ..... F16J 15/0825 277/595
5,387,014 A * 2/1995 Chevallier ..... B60H 1/00571 285/124.2
5,419,127 A * 5/1995 Moore, III ..... F01N 13/102 60/322
6,789,386 B1 * 9/2004 Haerle ..... F01N 3/2842 277/591
2002/0059795 A1 * 5/2002 Durr ..... F01N 13/102 60/323

(Continued)

FOREIGN PATENT DOCUMENTS

CN 103398246 A 11/2013
DE 1 025 211 B 2/1958

(Continued)

OTHER PUBLICATIONS

Machine Translation of DE-102005025732, Translated on May 24, 2016.*
Chinese Office Action dated Jan. 24, 2017.

*Primary Examiner* — Patrick Maines
(74) *Attorney, Agent, or Firm* — Hudak, Shunk & Farine Co. LPA

(57) ABSTRACT

An exhaust pipe flange with an exhaust gas pipe and with a flange plate fastened to the exhaust gas pipe, wherein the flange plate has an inner side which can be turned toward a cylinder head with a sealing surface which can be placed directly or indirectly against a cylinder head, and a seat in which the exhaust gas pipe is received. The exhaust gas pipe is joined to the flange plate and sealed in the region of the seat on the inner side by a welded connection.

25 Claims, 3 Drawing Sheets

(56) References Cited

U.S. PATENT DOCUMENTS

| | | | | |
|---|---|---|---|---|
| 2005/0268602 | A1* | 12/2005 | Smatloch | F01N 13/10 60/323 |
| 2008/0138233 | A1* | 6/2008 | Tomita | C21D 6/002 420/61 |
| 2009/0266065 | A1* | 10/2009 | Barrieu | F01N 13/102 60/323 |
| 2011/0303179 | A1* | 12/2011 | Coe | F01N 13/10 123/193.5 |
| 2015/0059324 | A1* | 3/2015 | Grussmann | F01N 13/102 60/323 |
| 2015/0226106 | A1* | 8/2015 | Murakami | F01N 13/10 60/323 |

FOREIGN PATENT DOCUMENTS

| | | | | | |
|---|---|---|---|---|---|
| DE | 1 164 156 | B | | 2/1964 | |
| DE | 100 34 365 | A1 | | 12/2001 | |
| DE | 10034365 | A1 | * | 12/2001 | F01N 13/1838 |
| DE | 20 2005 019 046 | U1 | | 3/2006 | |
| DE | 10 2005 025 731 | A1 | | 12/2006 | |
| DE | 10 2005 025 732 | A1 | | 12/2006 | |
| DE | 102005025732 | | * | 12/2006 | F01N 13/102 |
| GB | 1115960 | | | 6/1968 | |
| JP | 2 112928 | U | | 9/1990 | |
| JP | 2003172136 | A | * | 6/2003 | |

* cited by examiner

EXHAUST PIPE FLANGE

FIELD OF THE INVENTION

The invention pertains to an exhaust pipe flange with an exhaust gas pipe and with a flange plate fastened to the exhaust gas pipe, wherein the flange plate has an inner side which can be turned toward a cylinder head with a sealing surface and a seat in which the exhaust gas pipe is received.

Moreover, the invention pertains to an exhaust pipe flange with an exhaust gas pipe and with a flange plate fastened to the exhaust gas pipe, wherein the flange plate has an inner side facing a cylinder head with a sealing surface which can be placed directly or indirectly against a cylinder head, an opposite outer side, and a seat in which the exhaust gas pipe is received.

BACKGROUND OF THE INVENTION

There is already known from DE 20 2005 019 046 U1 a cylinder head of an internal combustion engine with an exhaust pipe flange fastened to it. The exhaust pipe flange consists of an elbow pipe with band and a flange plate which can be placed axially against the elbow pipe or band, wherein the flange plate has a bulge in the form of a collar, which comes to bear axially against the elbow pipe. Inside the bulge is arranged a deformable sealing ring preferably made of plastic, which bears against and seals the cylinder head, the band and the collar.

SUMMARY OF THE INVENTION

The problem which is solved by the invention is to configure and arrange an exhaust pipe flange so that a simplified fabrication is ensured.

The problem is solved according to the invention in that the exhaust gas pipe is joined to the flange plate in the region of the seat on the inner side by a welded connection. This means that the exhaust pipe flange can remain free of weld seams on its outer side in the region of the manifold. Furthermore, the exhaust pipe flange can be welded from the freely accessible side, opposite the manifold. Thanks to the plenty of space available on the inner side of the flange plate, the use of simplified welding methods and welding equipment is possible.

Furthermore, the distance between the flange plate and the exhaust gas pipe or an exhaust gas manifold formed of several exhaust gas pipes can be reduced to a minimum, so that ample space can be provided.

It can also be advantageous for this if a recess with a support surface is provided around the exhaust gas pipe on the inner side, which stands back in relation to the sealing surface by a dimension a of at least 2 mm to 3 mm, and the weld connection is provided at least partly in the recess and on the support surface. The recess serves to accommodate the weld seam, so that the flange plate can be placed directly or indirectly against the cylinder head or a cooling body. Thus, a separate slot in the cylinder head is not necessary, but it can be used in addition.

Moreover, it can be advantageous for the weld connection to protrude by a dimension b of at least 0.5 mm to 3 mm above the sealing surface for mounting on a cylinder head having a slot at an outlet opening in which the weld seam can be at least partly accommodated. Insofar as the cylinder head has a corresponding slot at an outlet opening, this will serve to accommodate the weld seam, so that the flange plate can be placed directly or indirectly against the cylinder head or a cooling body.

It can also be advantageous to provide a cooling body with a receiving opening, which is placed on one end of the exhaust gas pipe via the receiving opening and can be placed directly or indirectly against the sealing surface of the flange plate. The cooling body or at least one wall surface thereof is received in sandwich fashion between the flange plate and the cylinder head after the installation. Since the cooling body is not welded to the flange plate or the exhaust gas pipe, it can be brought to bear directly or indirectly against the cylinder head via a seal, with no further measures.

It can be advantageous for the cooling body to have a slot at the receiving opening in which the weld connection is at least partly accommodated. The weld seam or weld bead can thus be received at least partly in the slot in the cooling body, so that the inner side of the flange plate can be tightened directly or indirectly via the seal against the cooling body. The cooling body, once again, lies against the cylinder head. The seal between the flange plate and the exhaust gas pipe is formed by the welded joint. A recess for the weld seam can also be provided in the flange plate.

The problem is also solved according to the invention in that a cooling body with a receiving opening is provided, which is placed on one end of the exhaust gas pipe via the receiving opening and can be placed directly or indirectly against the sealing surface of the flange plate, the exhaust gas pipe being connected to the flange plate and sealed by a weld seam on the outer side in the region of the seat. Since the welded seam is arranged on the outer side of the flange plate, the flange plate can bear against the cooling body or the cooling body can bear against the cylinder head with no further measures.

In connection with the configuration and arrangement of the invention it can be advantageous for the cooling body to have a coolant channel or to border on a coolant channel. By the cooling body or the coolant channel, the exhaust gas can be directly exposed to coolant. The resulting temperature gradient between cooled and noncooled parts of the exhaust gas pipe is enormous. Accordingly, it is advantageous to place the welded seam between the flange plate and the cooling body or a wall of a cooling body. The region of the exhaust gas pipe already having stresses due to the welding process or the welded seam is thus protected against further heat-induced stress.

Moreover, it can be advantageous to form the exhaust gas pipe from clamshells or to configure it as a shell manifold. The exhaust gas pipe is subjected to a welding process for the purpose of its fabrication, during which the shells or clamshells are joined together at the edge by a welded edge seam. By placing the welded seam on the inside of the flange plate, the welded seam can be arranged at the end face of the exhaust gas pipe. This avoids a welding over the welded edge seam and the associated stresses.

Furthermore, it can be advantageous to connect the respective exhaust gas pipe to an adjacent exhaust gas pipe, the exhaust gas pipes being of modular design and at least two identical exhaust gas pipes are coupled together. This ensures an overall very favorable elbow construction in the context of using clamshells.

BRIEF DESCRIPTION OF THE DRAWINGS

Other benefits and details of the invention are explained in the patent claims and in the specification, and presented in the figures. There are shown:

DETAILED DESCRIPTION OF THE INVENTION

Figure 1:
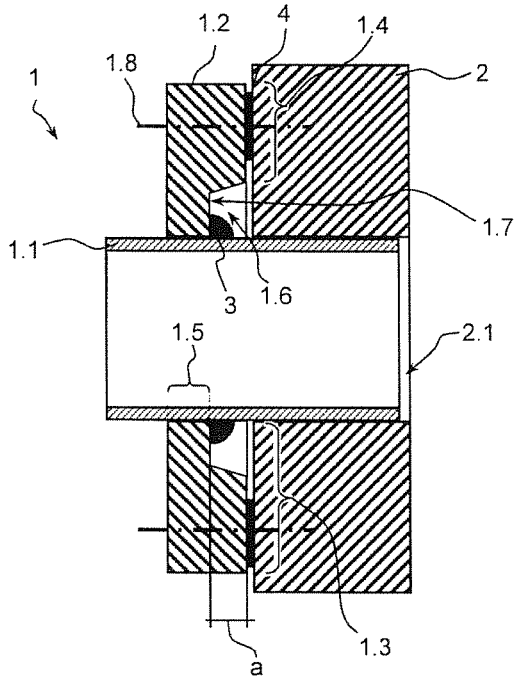
FIG. 1, a sectional representation as a schematic with flange plate and exhaust gas pipe.

According to the embodiment of FIG. 1, the exhaust pipe flange 1 is formed from a partly shown exhaust gas pipe 1.1, on which a flange plate 1.2 with a seat 1.5 fashioned as a recess has been shoved. The flange plate 1.2 is joined to the exhaust gas pipe 1.1 by a weld connection 3. The flange plate 1.2 has a recess 1.6, which is arranged around the receiving opening 1.5. Inside the recess 1.6, fashioned as an annular groove, there is formed a support surface 1.7, on which the weld connection 3 for joining the flange plate 1.2 to the exhaust gas pipe 1.1 is arranged or placed. The support surface 1.7 has an axial offset of dimension a in relation to an inner side 1.3 of the flange plate 1.2 or a sealing surface 1.4 of the flange plate 1.2, which is configured large enough so that the flange plate 1.2 can be placed directly or (as shown) indirectly via a seal 4 against a cylinder head 2 in sealing manner. The exhaust gas pipe 1.1 projects axially in the axial direction beyond the sealing surface 1.4 or the inner side 1.3 of the flange plate 1.2 and is introduced to corresponding length into an outlet opening 2.1 of the cylinder head 2.

The flange plate 1.2 or the subassembly consisting of flange plate 1.2 and exhaust gas pipe 1.1 is brought to bear against the cylinder head 2 by a screw connection 1.8, not otherwise shown.

Figure 5:
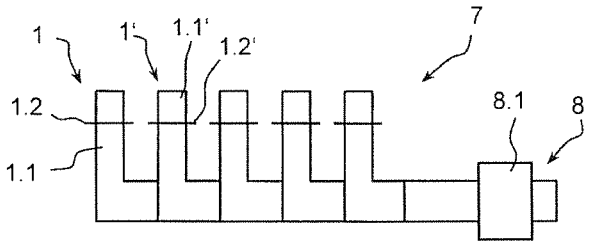
FIG. 5, a schematic of a group flange with exhaust system.

The exhaust gas pipe 1.1 here is part of an exhaust pipe flange 1 according to FIG. 5, wherein several exhaust gas pipes 1.1, 1.1' are joined into a group flange 7. Each time the respective exhaust gas pipe 1.1, 1.1' has a flange plate 1.2, 1.2', while as an alternative a collecting flange plate (not shown) for several exhaust gas pipes 1.1, 1.1' is also possible. The group flange 7 so formed is part of an exhaust system 8 with one or more exhaust gas after treatment components 8.1.

Figure 2:
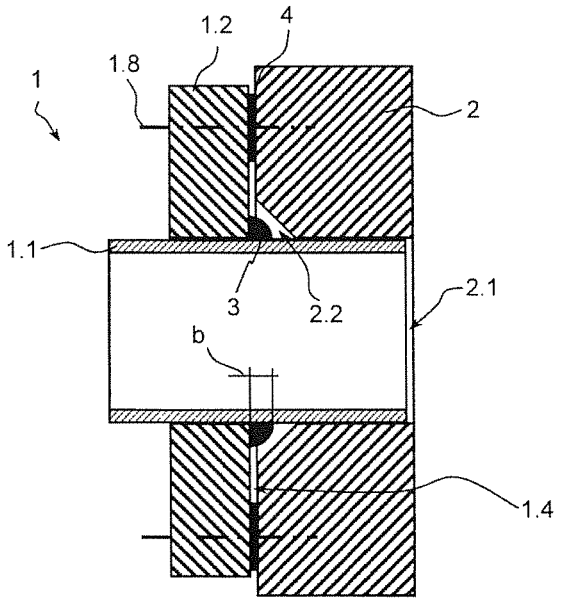
FIG. 2, a schematic per FIG. 1, with recess in the cylinder head.

According to the sample embodiment of FIG. 2, as an alternative to the recess 1.6 within the flange plate 1.2, a slot 2.2 is provided inside the cylinder head 2. The slot 2.2 runs around the outlet opening 2.1 or an edge of the outlet opening 2.1 in the manner of a bevel and serves to accommodate at least part of the weld connection 3. Depending on whether the flange plate 1.2 is brought to bear against the cylinder head 2 indirectly, i.e., without the use of a seal 4 (not shown), or directly with the use of a seal 4, a larger or smaller portion of the weld connection 3 will be arranged inside the slot 2.2.

The weld connection 3 is placed in this case between the exhaust gas pipe 1.1 and the sealing surface 1.4 of the flange plate 1.2, so that it projects in the axial direction beyond the sealing surface 1.4 by a dimension b. In the extent of this dimension b, the weld connection 3 will be accommodated by the slot 2.2, subtracting the thickness of the seal 4 in the axial direction. When the flange plate 1.2 bears directly against the cylinder head 2 without seal 4 (not shown), this receiving dimension corresponds to the dimension b.

Figure 3:
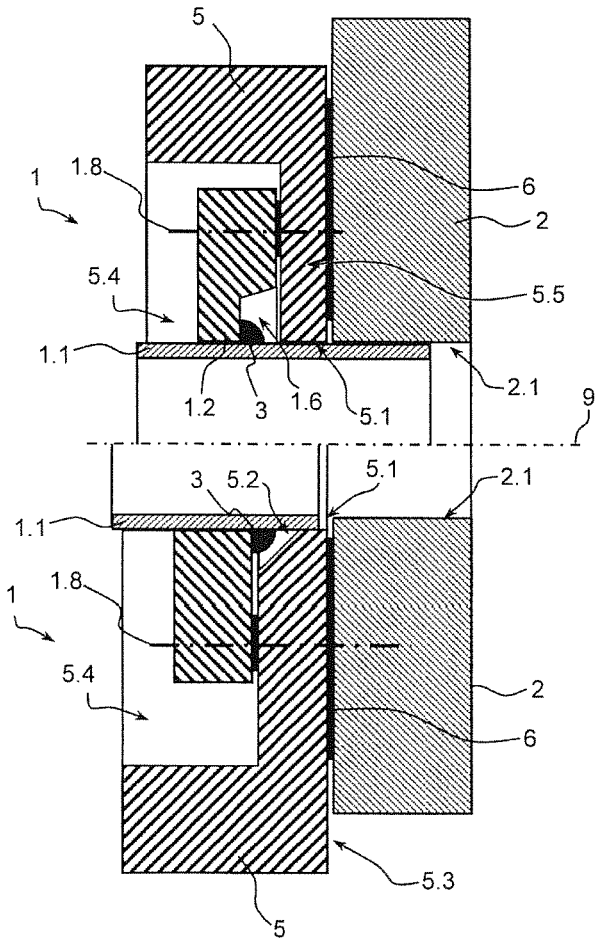
FIG. 3, a schematic per FIGS. 1 and 2 with cooling body.

The sample embodiment of FIG. 3 is partitioned in relation to a center axis 9 of the exhaust gas pipe 1.1 or the outlet opening 2.1 and represents two different embodiments. The upper half has a flange plate 1.2 with the recess 1.6 according to the sample embodiment of FIG. 1. In contrast to the sample embodiment of FIG. 1, a cooling body 5 is provided between the flange plate 1.2 and the cylinder head 2, against which the flange plate 1.2 is brought to bear across the seal 4. The cooling body 5 or a wall 5.5 of the cooling body, against which the flange plate 1.2 lies, is brought to bear against the cylinder head 2 across a seal 6 by its mounting surface 5.3, which is opposite the flange plate 1.2.

The weld connection 3 in this case is placed between the flange plate 1.2 and the cooling body 1.5 or the wall 5.5, while no weld connection 3 is provided between the wall 5.5 of the cooling body 5 and the cylinder head 2. Thus, the cooling body 5 can be brought to bear against the cylinder head 2 indirectly as shown, across the seal 6, or also directly, without the use of a seal 6 (not shown). Here as well the exhaust gas pipe 1.1 projects in the axial direction of the center axis 9 beyond the sealing surface 1.4 of the flange plate 1.2 and beyond the mounting surface 5.3 of the cooling body 5.5, so that it is accommodated within the outlet opening 2.1 of the cylinder head 2.

According to the embodiment of FIG. 3, bottom half of the picture, the cooling body 5 or the wall 5.5 of the cooling body 5 has a slot 5.2 in the region of a receiving opening 5.1 for the exhaust gas pipe 1.1. The flange plate 1.2 is joined to the exhaust gas pipe 1.1 by a weld connection 3, the weld connection 3 being placed at the sealing surface 1.4 of the flange plate 1.2, and therefore it projects in the axial direction beyond the sealing surface 1.4. Thus, when the flange plate 1.2 bears against the wall 5.5 of the cooling body 5, the weld connection 3 is accommodated by the slot 5.2. The exhaust gas pipe 1.1 does not project axially with respect to a mounting surface 5.3 of the cooling body 5 and accordingly neither is it accommodated within the outlet opening 2.1 of the cylinder head 2.

Figure 4:
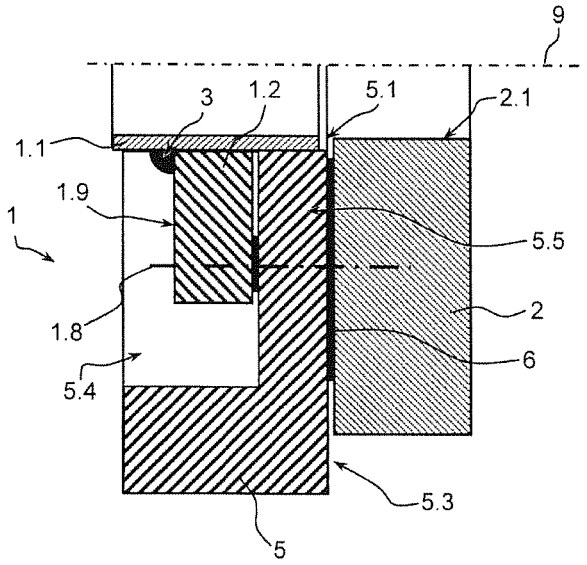
FIG. 4, a schematic per FIG. 3 (bottom) with welded seam on the outer side.

According to the sample embodiment of FIG. 4, just like the embodiment of FIG. 3, a cooling body 5 is provided, whose wall 5.5 is placed between the flange plate 1.2 and the cylinder head 2. The weld connection 3 in this case is placed on an outer side 1.9 of the flange plate, so that neither a recess 1.6 is necessary within the flange plate 1.2 nor a slot 5.2 within the cooling body 5 to accommodate the weld connection 3.

The cooling body 5 at least partly borders on a coolant channel 5.4. This coolant channel 5.4 is supplemented by corresponding use of a closure plate.

The invention further relates to the following:

1. An exhaust pipe flange, comprising: an exhaust gas pipe and a flange plate fastened to the exhaust gas pipe, wherein the flange plate has an inner side of the flange which can be turned toward a cylinder head with a sealing surface which can be placed directly or indirectly against a cylinder head, and a seat in which the exhaust gas pipe is received, wherein the exhaust gas pipe is joined to the flange plate and sealed in a region of the seat on the inner side by a welded connection.

2. The exhaust pipe flange according to 1, wherein a recess with a support surface is provided around the exhaust gas pipe on the inner side, which stands back in relation to the sealing surface by a dimension "a" of at least 2 mm to 3 mm, and the weld connection is provided at least partly in the recess and on the support surface.

3. The exhaust pipe flange according to 1 or 2, wherein the weld connection protrudes by a dimension "b" of at least 0.5 mm to 3 mm above the sealing surface for mounting on a cylinder head having a slot at an outlet opening in which the weld connection can be at least partly accommodated.

4. The exhaust pipe flange according to any of 1 to 3, wherein a cooling body with a receiving opening is provided, which is placed on one end of the exhaust gas pipe via the receiving opening and can be placed directly or indirectly against the sealing surface of the flange plate.

5. The exhaust pipe flange according to 4, wherein the cooling body has a slot at the receiving opening in which the weld connection is at least partly accommodated.

6. An exhaust pipe flange, comprising: an exhaust gas pipe and a flange plate fastened to the exhaust gas pipe, wherein the flange plate has an inner side which can be turned toward a cylinder head with a sealing surface which can be placed directly or indirectly against a cylinder head, an opposite outer side, and a seat in which the exhaust gas pipe is received, wherein a cooling body with a receiving opening is provided, which is placed on one end of the exhaust gas pipe via the receiving opening and can be placed directly or indirectly against the sealing surface of the flange plate, the exhaust gas pipe being connected to the flange plate and sealed by a weld connection on the outer side in the region of the seat.

7. The exhaust pipe flange according to any of 1 to 6, wherein the cooling body has a coolant channel or borders on a coolant channel.

8. The exhaust pipe flange according to any of 1 to 7, wherein the exhaust gas pipe is formed from clamshells or configured as a shell manifold.

9. A group flange with several exhaust pipe flanges according to any of 1 to 8, wherein the respective exhaust gas pipe is connected to an adjacent exhaust gas pipe, the exhaust gas pipes being of modular design and at least two identical exhaust gas pipes being coupled together.

10. An exhaust system of an internal combustion engine with an exhaust pipe flange or a group flange according to any of 1 to 9.

LIST OF REFERENCE NUMBERS

1 exhaust pipe flange
1' exhaust pipe flange
1.1 exhaust gas pipe
1.1' exhaust gas pipe
1.2 flange plate
1.2' flange plate
1.3 inner side
1.4 sealing surface
1.5 seat/opening
1.6 recess
1.7 support surface
1.8 screw connection
1.9 outer side
2 cylinder head
2.1 outlet opening
2.2 slot
3 welded connection, weld seam
4 seal
5 cooling body/wall of cooling body housing
5.1 receiving opening
5.2 slot
5.3 mounting surface
5.4 coolant channel
5.5 wall
6 seal
7 group flange
8 exhaust system
8.1 exhaust gas aftertreatment component
9 center axis
a dimension
b dimension

What is claimed is:

1. An exhaust pipe flange, comprising: an exhaust gas pipe and a flange plate fastened to the exhaust gas pipe, wherein the flange plate has an inner side of the flange turned toward a cylinder head with a sealing surface placed indirectly against the cylinder head, and a seat in which the exhaust gas pipe is received, wherein the exhaust gas pipe is joined to the flange plate and sealed in a region of the seat on the inner side by a welded connection, wherein a cooling body with a receiving opening is provided, which is placed on one end of the exhaust gas pipe via the receiving opening and is either placed directly against the sealing surface of the flange plate or indirectly against the sealing surface of the flange plate with a seal located between the cooling body and flange plate, wherein the exhaust gas pipe extends axially either a) into the receiving opening of the cooling body or b) through and beyond the receiving opening of the cooling body such that the exhaust gas pipe is accommodated within the outlet opening of the cylinder head.

2. The exhaust pipe flange according to claim 1, wherein a recess with a support surface is provided around the exhaust gas pipe on the inner side, which stands back in relation to the sealing surface by a dimension "a" of at least 2 mm and the weld connection is provided at least partly in the recess and on the support surface.

3. The exhaust pipe flange according to claim 2, wherein the weld connection protrudes by a dimension "b" of at least 0.5 mm above the sealing surface for mounting on a cylinder head having a slot at an outlet opening in which the weld connection can be at least partly accommodated.

4. The exhaust pipe flange according to claim 2, wherein the cooling body has a slot at the receiving opening in which the weld connection is at least partly accommodated.

5. The exhaust pipe flange according to claim 4, wherein the cooling body has a coolant channel or borders on a coolant channel.

6. The exhaust pipe flange according to claim 1, wherein the weld connection protrudes by a dimension "b" of at least 0.5 mm above the sealing surface for mounting on a cylinder head having a slot at an outlet opening in which the weld connection can be at least partly accommodated.

7. The exhaust pipe flange according to claim 1, wherein the cooling body has a slot at the receiving opening in which the weld connection is at least partly accommodated.

8. The exhaust pipe flange according to claim 7, wherein the cooling body has a coolant channel or borders on a coolant channel.

9. The exhaust pipe flange according to claim 1, wherein the cooling body has a coolant channel or borders on a coolant channel.

10. The exhaust pipe flange according to claim 1, wherein the exhaust gas pipe is formed from clamshells or configured as a shell manifold.

11. A group flange with several exhaust pipe flanges and several exhaust gas pipes according to claim 1, wherein the respective exhaust gas pipe is connected to an adjacent exhaust gas pipe, the exhaust gas pipes being of modular design and at least two identical exhaust gas pipes being coupled together.

12. An exhaust system of an internal combustion engine with an exhaust pipe flange or a group flanges according to claim 11.

13. An exhaust system of an internal combustion engine with the exhaust pipe flange according to claim 1.

14. The exhaust pipe flange according to claim 1, wherein a seal is present between the cylinder head and the cooling body by which the cooling body is sealingly attached to the cylinder head.

15. An exhaust pipe flange, comprising: an exhaust gas pipe and a flange plate fastened to the exhaust gas pipe, wherein the flange plate has an inner side turned toward a cylinder head with a sealing surface placed indirectly against the cylinder head, an opposite outer side, and a seat in which the exhaust gas pipe is received, wherein a cooling body with a receiving opening is provided, which is placed on one end of the exhaust gas pipe via the receiving opening and is either placed directly against the sealing surface of the flange plate or indirectly against the sealing surface of the flange plate with a seal located between the cooling body and flange plate, the exhaust gas pipe being connected to the flange plate and sealed by a weld connection on the outer side in the region of the seat, wherein the exhaust gas pipe extends axially either a) into the receiving opening of the cooling body or b) through and beyond the receiving opening of the cooling body such that the exhaust gas pipe is accommodated within the outlet opening of the cylinder head.

16. The exhaust pipe flange according to claim 15, wherein the cooling body has a coolant channel or borders on a coolant channel.

17. A group flange with several exhaust pipe flanges and several exhaust gas pipes according to claim 15, wherein the respective exhaust gas pipe is connected to an adjacent exhaust gas pipe, the exhaust gas pipes being of modular design and at least two identical exhaust gas pipes being coupled together.

18. The exhaust pipe flange according to claim 15, wherein the exhaust gas pipe is formed from clamshells or configured as a shell manifold.

19. An exhaust system of an internal combustion engine with the exhaust pipe flange according to claim 15.

20. An exhaust pipe flange, comprising: an exhaust gas pipe and a flange plate fastened to the exhaust gas pipe, wherein the flange plate has an inner side of the flange turned toward a cylinder head with a sealing surface placed indirectly against the cylinder head, and a seat in which the exhaust gas pipe is received, wherein the exhaust gas pipe is joined to the flange plate and sealed in a region of the seat on the inner side by a welded connection, wherein a cooling body with a receiving opening is provided, which is placed on one end of the exhaust gas pipe via the receiving opening and is either placed directly against the sealing surface of the flange plate or indirectly against the sealing surface of the flange plate with a seal located between the cooling body and flange plate, wherein the cooling body has a slot at the receiving opening in which the weld connection is at least partly accommodated.

21. The exhaust pipe flange according to claim 20, wherein a recess with a support surface is provided around the exhaust gas pipe on the inner side, which stands back in relation to the sealing surface by a dimension "a" of at least 2 mm and the weld connection is provided at least partly in the recess and on the support surface.

22. The exhaust pipe flange according to claim 21, wherein the cooling body has a coolant channel or borders on a coolant channel.

23. The exhaust pipe flange according to claim 20, wherein the cooling body has a coolant channel or borders on a coolant channel.

24. An exhaust pipe flange, comprising: an exhaust gas pipe and a flange plate fastened to the exhaust gas pipe, wherein the flange plate has an inner side of the flange turned toward a cylinder head with a sealing surface placed indirectly against the cylinder head, and a seat in which the exhaust gas pipe is received, wherein the exhaust gas pipe is joined to the flange plate and sealed in a region of the seat on the inner side by a welded connection, wherein a cooling body with a receiving opening is provided, which is placed on one end of the exhaust gas pipe via the receiving opening and is either placed directly against the sealing surface of the flange plate or indirectly against the sealing surface of the flange plate with a seal located between the cooling body and flange plate, and wherein the cooling body has a portion that projects past an outer side of the flange plate in an axial direction of the exhaust gas pipe.

25. An exhaust pipe flange, comprising: an exhaust gas pipe and a flange plate fastened to the exhaust gas pipe, wherein the flange plate has an inner side of the flange turned toward a cylinder head with a sealing surface placed indirectly against the cylinder head, and a seat in which the exhaust gas pipe is received, wherein the exhaust gas pipe is joined to the flange plate and sealed in a region of the seat on the inner side by a welded connection, wherein a cooling body with a receiving opening is provided, which is placed on one end of the exhaust gas pipe via the receiving opening and is either placed directly against the sealing surface of the flange plate or indirectly against the sealing surface of the flange plate with a seal located between the cooling body and flange plate, and wherein the cooling body extends a further distance from the cylinder head than the flange plate in an axial direction of the exhaust gas pipe.

* * * * *